US009207602B2

(12) United States Patent
Hatazaki

(10) Patent No.: US 9,207,602 B2
(45) Date of Patent: Dec. 8, 2015

(54) IMAGE HEATING APPARATUS

(71) Applicant: CANON KABUSHIKI KAISHA, Tokyo (JP)

(72) Inventor: Kazunari Hatazaki, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/304,173

(22) Filed: Jun. 13, 2014

(65) Prior Publication Data

US 2014/0369728 A1 Dec. 18, 2014

(30) Foreign Application Priority Data

Jun. 18, 2013 (JP) ..... 2013-127137

(51) Int. Cl.
*G03G 15/20* (2006.01)

(52) U.S. Cl.
CPC .... *G03G 15/2064* (2013.01); *G03G 2215/2009* (2013.01)

(58) Field of Classification Search
USPC ..... 399/67, 107, 110, 122, 320, 328–332; 219/216, 619
See application file for complete search history.

(56) References Cited

U.S. PATENT DOCUMENTS

| | | | | |
|---|---|---|---|---|
| 2005/0111862 | A1* | 5/2005 | Fuma et al. | 399/67 |
| 2011/0026960 | A1* | 2/2011 | Okamoto | 399/67 |
| 2011/0305473 | A1* | 12/2011 | Tamaki | 399/67 |
| 2012/0321360 | A1* | 12/2012 | Futamata et al. | 399/329 |
| 2013/0051831 | A1* | 2/2013 | Shinagawa et al. | 399/69 |
| 2013/0121739 | A1 | 5/2013 | Hatazaki | |
| 2013/0136461 | A1* | 5/2013 | Sakai | 399/18 |
| 2014/0270866 | A1 | 9/2014 | Hatazaki | |
| 2014/0270867 | A1 | 9/2014 | Hatazaki | |
| 2014/0270868 | A1 | 9/2014 | Chiyoda et al. | |

FOREIGN PATENT DOCUMENTS

JP 11-002979 A 1/1999

* cited by examiner

*Primary Examiner* — Hoan Tran
(74) *Attorney, Agent, or Firm* — Fitzpatrick, Cella, Harper & Scinto

(57) ABSTRACT

An image heating apparatus includes a rotatable member and an endless belt configured to form a nip portion cooperatively with the rotatable member. A pressing pad is provided in the inside of the endless belt and configured to press the endless belt toward the rotatable member to form the nip portion. The pressing pad includes a first portion extending from an entrance of the nip portion toward an exit of the nip portion in a sheet conveying direction and a second portion disposed at a region in which the sheet is separated from the rotatable member. The first and second portions are pressed toward the rotatable member independently by a pressing mechanism.

6 Claims, 13 Drawing Sheets

IMAGE HEATING APPARATUS

BACKGROUND OF THE INVENTION

1. Field of the Invention

The present invention relates to an image heating apparatus which heats an image formed on a recording medium such as paper.

2. Description of the Related Art

In the related art, an image forming apparatus such as a copying machine, a printer, a facsimile, or a multifunction machine of these, which uses an electrophotographic method, includes a fixing unit which is an image heating apparatus that heats and presses a toner image formed on a recording medium, and then fixes the image on the recording medium. In addition, as such a fixing unit, there is an apparatus having a configuration in which the glossiness of an image on a recording medium is adjusted by heating and pressing again the recording medium to which the image is fixed, in addition to fixation of the toner image on the recording medium.

As a configuration of such a fixing unit, a configuration in which a nip portion that pinches and conveys a recording medium is formed between a fixing roller serving as a rotatable member and an endless belt is known in the related art. For example, in JP-A-11-2979, a configuration in which a nip portion is formed between a fixing roller and an endless belt by arranging a pressure pad and a separation roller in the endless belt and separately biasing the pressure pad and the separation roller has been proposed.

In this configuration, the recording medium is separated from the fixing roller by a curvature of the separation roller.

In the case of the configuration disclosed in JP-A-11-2979 described above, the separation roller can move relatively with respect to the pressure pad in order to separately bias the pressure pad and the separation roller. For this reason, a predetermined gap is necessary to be provided between the separation roller and the pressure pad. In such a configuration, for example, in a case where a recording medium having low air permeability such as coated paper is used, an icicle-like portion with low gloss (for example, see FIG. 10, hereinafter referred to as gloss unevenness) can be generated on an image.

That is, in the case of the recording medium with low permeability, such as coated paper, an image disturbance occurs due to the expansion of the air in the inside of the nip portion or the generation of water vapor. More specifically, the air existing in a non-fixed toner layer stays in a gap between the pressure pad, which is a portion with low pressure of the nip portion, and the separation roller. In addition, the air allows a void to be partially generated in the interface between the recording medium and the fixing roller and disturbs the toner image, which is not completely fixed so that the above-described gloss unevenness is generated.

SUMMARY OF THE INVENTION

According to a first aspect of the present invention, there is provided an image heating apparatus which includes a rotatable member, an endless belt configured to form a nip portion, in which a toner image on a sheet is heated, cooperatively with the rotatable member, and a pressing pad provided in the inside of the endless belt and configured to press the endless belt toward the rotatable member to form the nip portion. The pressing pad includes a first portion extending from the entrance of the nip portion toward and the exit of the nip portion in a sheet conveying direction, and a second portion disposed at a region in which the sheet is separated from the rotatable member. The pressure in the second portion is higher than that in the first portion. The image heating apparatus also includes a pressing mechanism configured to press the first portion and the second portion toward the rotatable member independently.

According to a second aspect of the present invention, there is provided an image heating apparatus which includes a rotatable member, an endless belt configured to form a nip portion, in which a toner image on a sheet is heated, cooperatively with the rotatable member, and an integrated member provided in the inside of the endless belt and configured to press the endless belt toward the rotatable member to form the nip portion. The integrated member includes a pad member extended from an entrance of the nip portion toward an exit of the nip portion in a sheet conveying direction, and a separation rotary body positioned downstream of the pad member, configured to be movable with respect to the pad member only in a sheet conveying direction, and rotating by contacting with the endless belt. The image heating apparatus also includes a pressing mechanism configured to press the pad member and the separation rotary body toward the rotatable member independently.

Further features of the present invention will become apparent from the following description of exemplary embodiments with reference to the attached drawings. The accompanying drawings, which are incorporated in and constitute apart of the specification, illustrate exemplary embodiments, features, and aspects of the invention and, together with the description, serve to explain the principles of the invention.

DESCRIPTION OF THE EMBODIMENTS

Figure 1:
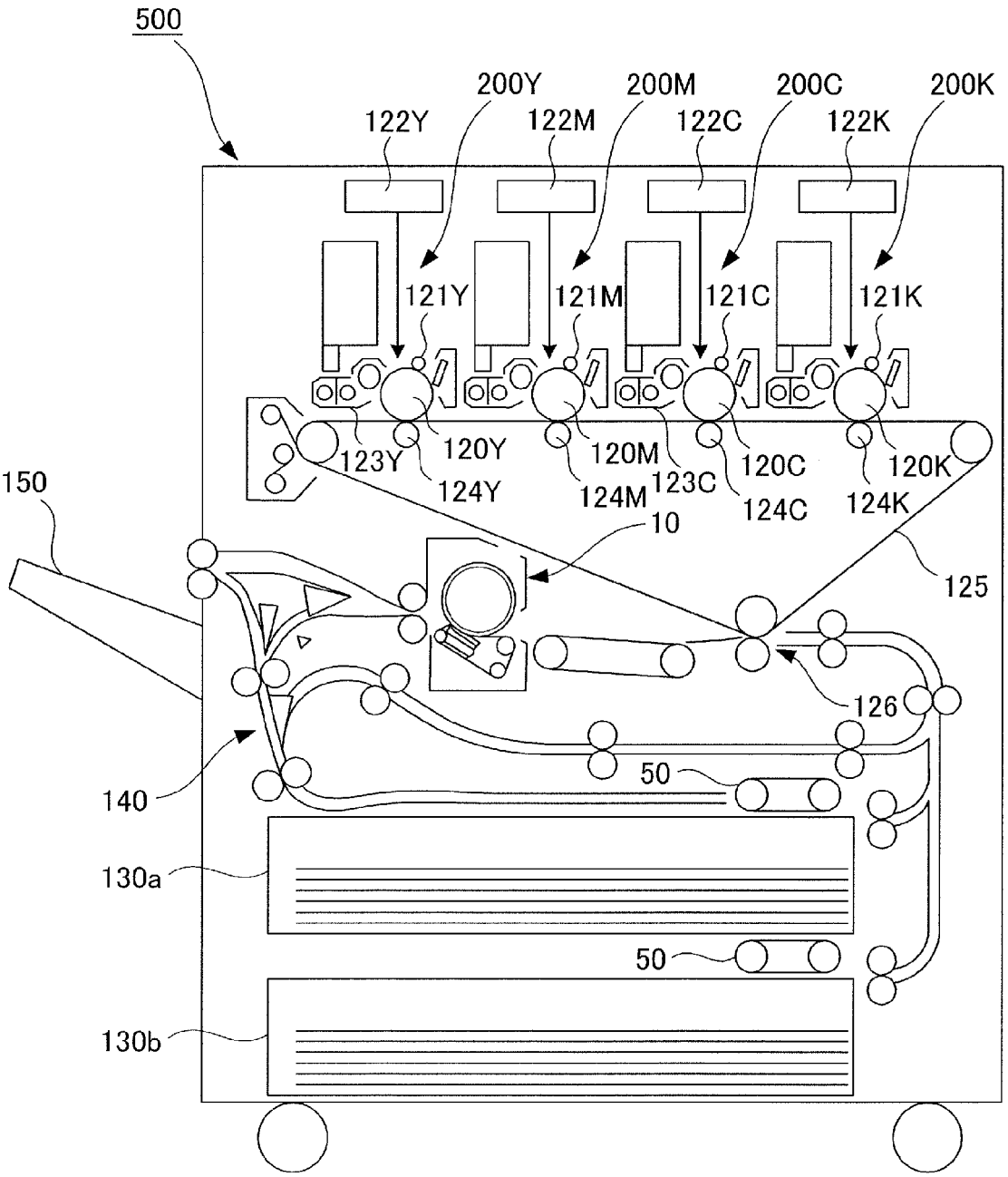
FIG. 1 is a cross-sectional view schematically illustrating the configuration of an image forming apparatus according to a first embodiment of the present invention.

A first embodiment of the present invention will be described with reference to FIGS. 1 to 7. First, a schematic configuration of an image forming apparatus including a fixing unit as an image heating apparatus of the present embodiment will be described with reference to FIG. 1.

<Image Forming Apparatus>

An image forming apparatus 500 includes image forming units 200Y, 200M, 200C, and 200K having respective colors of Y (yellow), M (magenta), C (cyan), and K (black) which are arranged in series in the rotation direction of an intermediate transfer belt (intermediate transfer member) 125. That is, the image forming apparatus 500 is an image forming apparatus in which a tandem system in which processes performed for visualization of an image are parallel processed for each color is adopted. Since the basic configurations of respective image forming units 200Y, 200M, 200C, and 200K are the same as each other, hereinafter, the descriptions of the indexes Y, M, C, and K indicating the configurations of respective image forming units are omitted. In addition, the arrangement order of the image forming units of respective colors Y, M, C, and K is not limited to this index order.

The image forming unit 200 includes the following process portions, which are a photoconductive drum 120 as an image carrier that carries an electrostatic latent image on the surface corresponding to respective colors of Y, M, C, and K, a primary charging unit 121, an exposure unit 122, and a developing unit 123. The primary charging unit 121 uniformly charges the corresponding surface of the photoconductive drum 120 by applying a charging bias voltage of a set potential thereto, exposing the surface by the exposure unit 122, and then forming an electrostatic latent image. The electrostatic latent image is developed with a toner by the developing unit 123 and visualized as a toner image.

Respective toner images, which are formed on the surface of the photoconductive drum 120 and then carried, are sequentially overlapped on the intermediate transfer belt 125 as the endless belt to be primarily transferred by a primary transfer unit 124. The thickness of an end portion of a recording medium such as paper or an OHP sheet, which is fed from either of sheet feeding cassettes 130*a* and 130*b*, is decreased by being passed through a compression unit 50. Accordingly, damage applied to the fixing unit 10 and a secondary transfer unit 126 by the recording medium is reduced.

The toner images on the intermediate transfer belt 125 to which all colors of Y, M, C, and K are primarily transferred by the primary transfer unit 124 are then secondarily transferred collectively onto the recording medium fed from the sheet feeding cassette 130*a* or 130*b* by the secondary transfer unit 126. The recording medium carrying the transferred toner images is conveyed to the fixing unit 10. In the fixing unit 10, non-fixed toner images are fixed by adding heat and pressure thereto by pinching the recording medium in a fixing nip portion. Next, the recording medium is conveyed toward a discharge tray 150, a both-surfaces conveyance path 140 of a recording medium, or the like. In this manner, in the image forming apparatus 500, a series of image forming processes, for example, charging, exposing, developing, transferring, and fixing are performed and a color toner image is formed on the recording medium and then discharged. In addition, in the fixing unit 10, in addition to the fixation of the toner image to the recording medium, the glossiness of the image on the recording medium may be adjusted by heating and pressing again the recording medium to which the image is fixed.

<Fixing Unit>

Next, the fixing unit 10 as an image heating apparatus will be described with reference to FIG. 2. The fixing unit 10 includes a fixing roller 51 as a rotatable member, a fixing belt 52 as an endless belt, an integrated pad 100 as an integrated member, a heater 58 as heating portion, and a pressure mechanism 60.

The fixing roller 51 is rotatably arranged and is rotated and driven in the arrow A direction in the figure by the rotation of the fixing belt 52 described below. In such a fixing roller 51, for example, a silicone rubber layer having a thickness of 2 mm is formed as an elastic layer 51*b* in the periphery of a metal core 51*a* configured of an aluminum alloy having a thickness of 2 mm. The elastic layer 51*b* is coated with a PFA tube having a thickness of 50 μm as a release layer 51*c*. Further, the outer diameter of the fixing roller 51 is set to, for example, 60 mm.

The heater 58, such as a halogen lamp, is disposed in the inside of the fixing roller 51. The heater 58 generates heat through energization and heats the fixing roller 51 so that the toner image formed on the recording medium conveyed to a nip portion N described below is heated. In addition, a thermistor (not illustrated) is disposed in contact or non-contact with the fixing roller 51, so the temperature of the surface of the fixing roller 51 is adjusted to a predetermined temperature by controlling the energization to the heater 58 through a temperature adjusting circuit.

The fixing belt 52 is arranged to be capable of contacting and separating from the fixing roller 51, and the fixing belt 52 rotates in a state in which the fixing belt 52 contacts the fixing roller 51. Such a fixing belt 52 has a polyimide base layer having a thickness of 100 μm and a silicone rubber layer having a thickness of 0.2 mm on the base layer, and the outer diameter of the fixing belt is 90 mm. Further, the fixing belt 52 of the present embodiment is a seamless belt.

Moreover, the fixing belt 52 is stretched around an entrance roller 55, a driving roller (not illustrated), a steering roller 57, and an integrated pad 100. In addition, a lubricant application roller 59 is arranged between the entrance roller 55 and the integrated pad 100 in the inside of the fixing belt 52 such that the lubricant application roller 59 comes into contact with the inner peripheral surface of the fixing belt 52. The fixing belt 52 is rotated by a driving force input to the driving roller from a motor serving as a driving source (not illustrated), and the entrance roller 55, the steering roller 57, and the lubricant application roller 59 are driven and rotated by the fixing belt 52.

The entrance roller 55 is a roller arranged in the entrance side in which the recording medium enters the fixing unit 10, and the position of the rotation center is fixed such that the conveyance path of the recording medium is not changed. In the steering roller 57, a predetermined tension is applied to the fixing belt 52 and at least one of both end portions is movably supported in the arrow B direction in the figure. An end portion of the steering roller 57 is controlled so as to be moved in the arrow B direction by a control unit (not illustrated) based on, for example, a signal of a sensor which detects the position of an end portion in a roller shaft direction (width direction) of the fixing belt 52. Accordingly, the fixing belt 52 is controlled so as to remain in a constant position in the width direction with respect to the entrance roller 55.

The lubricant application roller 59 is impregnated with, for example, silicone-based oil as a lubricant and applies the lubricant to the inner peripheral surface of the fixing belt 52. In addition, the lubricant application roller 59 may be omitted and the lubricant may be directly applied to the inner peripheral surface of the fixing belt 52. In both ways, the slidability of the fixing belt 52 and the integrated pad 100 to be described below are improved by applying the lubricant to the inner peripheral surface of the fixing belt 52.

The integrated pad 100, as a pressing pad, is arranged in the inside of the fixing belt 52 and configured to press the endless belt 52 toward the fixing roller 51 to form the nip portion N, which is formed by the endless belt 52 cooperatively with the fixing roller 51 and heats a toner image on a sheet (recording medium). Specifically the integrated pad 100 is configured by integrally forming a pad portion (first portion) 101 as a nip forming portion and a separation portion (second potion) 102 disposed at a region in which the sheet is separated from the fixing roller 51. The pad portion 101 forms the nip portion N for pinching and conveying the recording medium by pinching the fixing belt 52 with the fixing roller 51. For this reason, the pad portion 101 extends from an entrance of the nip portion N toward an exit of the nip portion in the sheet conveying direction and is configured of a pad base 101*b* formed of metals, such as an aluminum alloy, or a synthetic resin having heat resistance, or the like, and an elastic layer 101*a*, such as a silicone rubber layer, fixed on the pad base 101*b*. That is, the pad portion 101 has a double structure having the elastic layer 101*a* fixed to the pad base 101*b*.

The pad base 101*b* is fixed to a pad holder 103 having sufficient rigidity with respect to the pressing force due to a pressure mechanism 60 described below, and accordingly, deflection of the pad base 101*b* is suppressed. In a portion which slides with the fixing belt 52 of the integrated pad 100, at least the surface of the elastic layer 101*a* is covered by a sliding sheet 104. As the sliding sheet 104, for example, a PI sheet, which is coated with PTFE, is used. In this manner, the sliding resistance between the integrated pad 100 and the fixing belt 52, and particularly the sliding resistance between the surface of the elastic layer 101*a* and the inner peripheral surface of the fixing belt 52 is reduced. In the present embodiment, the integrated pad 100 is configured of such a pad portion 101, the separation portion 102 described below, the pad holder 103, and the sliding sheet 104.

The separation portion 102 is disposed downstream of the pad portion 101 in the rotation direction of the fixing belt 52 (in the sheet conveying direction) and separates the recording medium conveyed to the nip portion N from the fixing roller 51. In the present embodiment, the separation portion 102 is integrally formed with the pad portion 101 on the downstream end portion of the pad portion 101 in the rotation direction of the fixing belt (in the sheet conveying direction) and includes an outer peripheral surface 102*a* having a predetermined curvature which slides with respect to the inner peripheral surface of the fixing belt 52. Specifically, the separation portion 102 is configured by allowing the downstream end portion of the pad base 101*b* to be projected to the fixing roller 51 side and forming the outer peripheral surface 102*a* having a predetermined curvature. The elastic layer 101*a* of the pad portion 101 is in close contact with the side surface of the separation portion 102 without a gap therebetween.

In the example as shown in the figure, the surface of the fixing roller 51 side of the pad base 101*b* is configured of a flat surface 110, the outer peripheral surface 102*a* of the separation portion 102 which is projected to the fixing roller 51 side when compared to the flat surface 110, and a continuous surface 111, which makes the flat surface 110 and the outer peripheral surface 102*a* continuous. The continuous surface 111 is a surface which is smoothly inclined or curved toward the outer peripheral surface 102*a* of the separation portion 102 from the flat surface 110. Further, the elastic layer 101*a* is, for example, adhered onto the flat surface 110 and the continuous surface 111 for fixation.

With such a configuration, the recording medium passing through the nip portion N, which is formed by the pad portion 101, is easily separated from the fixing roller 51 by the curvature of the outer peripheral surface 102*a* of the separation portion 102. In addition, in a case where the nip portion N is formed of the fixing belt 52 and the fixing roller 51, the width of the nip portion N along the conveyance direction of the recording medium can be easily set to be large by adjusting the width in contact with the fixing roller 51 of the fixing belt 52. Therefore, since the width of the nip portion can be secured without depending on the diameter of the fixing roller 51, the diameter and the heat capacity of the fixing roller 51 can be reduced so that a start-up time can be shortened. That is, since such a belt-type fixing unit can allow more toners to be melted, the fixing unit is suitable for an image forming apparatus using a large amount of toner, for example, a color image forming apparatus.

<Pressure Mechanism>

Next, the pressure mechanism 60, which presses the integrated pad 100 toward the fixing roller 51, will be described. The pressure mechanism 60 includes a first pressing portion (first pressing member) 61 and a second pressing portion (second pressing portion) 62. The first pressing portion 61 presses an upstream part in the sheet conveying direction (the rotation direction of the fixing belt 52) of the integrated pad 100 toward the fixing roller 51. The second pressing portion 62 presses the downstream part in the sheet conveying direction (the rotation direction of the fixing belt 52) of the integrated pad 100 toward the fixing roller 51 independently from the first pressing portion 61.

For this reason, the first pressing portion 61 includes a first arm 61*a* as a first swing member and a first spring 61*b* as a first biasing member. The first arm 61*a* is swingably supported by a swing shaft 63 arranged in parallel with the entrance roller 55 in the arrow C direction in the figure. The first spring 61*b* is arranged in a state of being elastically compressed between the first arm 61*a* and a moving member 64*a* constituting a cam mechanism 64 described below and biases the first arm 61*a* toward the integrated pad 100 using an elastic restoring force.

The second pressing portion 62 includes a second arm 62*a* as a second swing member and a second spring 62*b* as a second biasing member. The second arm 62*a* is swingably supported by the above-described swing shaft 63 in the arrow D direction in the figure independently from the first arm 61*a*. The second spring 62*b* is arranged in a state of being elastically compressed between the second arm 62*a* and the moving member 64*a* and biases the second arm 62*a* toward the integrated pad 100 using the elastic restoring force.

A rotating shaft 103*a* on the upstream side and a rotating shaft 103*b* on the downstream side are respectively provided in portions close to both ends of the pad holder 103 of the integrated pad 100 in the belt rotation direction. Further, a portion close to the front end of the first arm 61*a* and a portion close to the front end of the second arm 62*a* are brought into contact with the rotating shaft 103*a* on the upstream side and the rotating shaft 103*b* on the downstream side, respectively. In this manner, the integrated pad 100 is pressed toward the fixing roller 51 by the first pressing portion 61 and the second pressing portion 62 as indicated by the arrows E and F in the figure. In the present embodiment, the pressing force of the second pressing portion 62 is larger than that of the first pressing portion 61. For example, the strength applied to the rotating shaft 103*a* on the upstream side from the first pressing portion 61 is set to 400 N ({near=} 40 kgf) and the strength applied to the rotating shaft 103*b* on the downstream side from the second pressing portion 62 is set to 600 N ({near=} 60 kgf).

In addition, either member of the first arm 61*a* and the second arm 62*a* supports the integrated pad 100 such that the integrated pad is only rotatable and the other member supports the integrated pad 100 such that the integrated pad is rotatable and movable along the other member. Specifically, an arc-shaped recessed groove 61*c* is formed in the portion close to the front end of the first arm 61*a* and the rotating shaft 103*a* on the upstream side is rotatably engaged with the recessed groove 61*c*. In contrast, the portion close to the front end of the second arm 62*a* in contact with the rotating shaft 103*b* on the downstream side is an abutting surface 62*c* with no grooves formed thereon. With this configuration, the first arm 61*a* supports the integrated pad 100 such that the integrated pad 100 is only rotatable by the engagement of the rotating shaft 103*a* on the upstream side and the recessed groove 61*c*. In contrast, the second arm 62*a* supports the integrated pad 100 such that the integrated pad 100 is rotatable and is movable along the second arm 62*a* because the rotating shaft 103*b* on the downstream side is rotatable on the abutting surface 62*c* and movable along the abutting surface 62*c*. By constituting a link mechanism with the first arm 61*a*, the second arm 62*a*, and the pad holder 103 of the integrated pad 100, the first arm 61*a* and the second arm 62*a* are allowed to be swung about the swing shaft 63 and the integrated pad 100 becomes pressable.

Further, the link mechanism for pressing the integrated pad 100 may have another configuration. For example, the configuration in which the first arm 61*a* supports the integrated pad 100 such that the integrated pad 100 is only rotatable may become a configuration in which a hole for fitting the rotating shaft 103*a* on the upstream side may be formed in the first arm 61*a* or the relationship between the shaft and the hole or the recessed groove may be reversed. In addition, the configuration in which the second arm 62*a* supports the integrated pad 100 such that the integrated pad 100 is rotatable and movable may become a configuration in which a long hole is formed in the second arm 62*a* and the long hole supports the rotating shaft 103*b* on the downstream side such that the rotating shaft is slidable, or the relationship of the shaft and the long hole or the abutting surface may be reversed. Moreover, for example, the above-described relationship may be reversed, that is, a configuration in which the second arm 62*a* supports the integrated pad 100 such that the integrated pad 100 is only rotatable and the first arm 61*a* supports the integrated pad 100 such that the integrated pad 100 is rotatable and movable may be adopted.

As described above, a first pressure position in which the integrated pad 100 is pressed by the first pressing portion 61 and a second pressure position in which the integrated pad 100 is pressed by the second pressing portion 62 are respectively arranged in the following positions. First, a first virtual line α passing through a rotation center O of the fixing roller 51 and the upstream end of the nip portion N in the belt rotation direction (the sheet conveying direction) and a second virtual line β passing through the rotation center O and the downstream end of the nip portion N in the belt rotation direction (the sheet conveying direction) are prescribed. In this case, the first pressure position is positioned upstream of the first virtual line α in the belt rotation direction and the second pressure position is positioned downstream of the second virtual line β in the belt rotation direction.

In the present embodiment, the first pressure position is a position in which the recessed groove 61*c* of the first arm 61*a* is engaged with the rotating shaft 103*a* on the upstream side. Accordingly, the rotating shaft 103*a* on the upstream side is arranged upstream of the first virtual line α in the belt rotation direction. In addition, the second pressure position is a position in which the abutting surface 62*c* of the second arm 62*a* comes into contact with the rotating shaft 103*b* on the downstream side of the apparatus. For this reason, the rotating shaft 103*b* on the downstream side of the apparatus is positioned downstream of the second virtual line β in the belt rotation direction. This portion that the rotating shaft 103*a* on the upstream side of the apparatus and the rotating shaft 103*b* on the downstream side of the apparatus are positioned outside an area G between the first virtual line α and the second virtual line β.

The reason for arranging the first pressure position and the second pressure position as described above will be described with reference to FIG. 3. In a case where the first pressure position and the second pressure position are present in the area G, a moment is generated using the rotating shaft 103*b* on the downstream side of the apparatus as a fulcrum with respect to the integrated pad 100 as indicated by the arrow in the figure when the front end of cardboard P, which is the recording medium, enters the upstream side of the nip portion N. As a result, the pressure on the downstream side of the nip portion N due to the integrated pad 100 is increased, and the strain applied to the sliding sheet 104 on the downstream side of the nip portion N or the fixing roller 51 is expanded, and thus the service life of the apparatus may be reduced. Further, also in the case in which the rear end of the cardboard is nipped only by the downstream side of the nip portion N, a moment is generated in a direction in which the pressure on the entrance side of the nip increases, and thus the service life of the apparatus may be reduced. In contrast, in a case where the first pressure position and the second pressure position are arranged outside the area G, the generation of the moment described above can be suppressed even in a state in which the front end or the rear end of the recording medium is nipped by the upstream side or the downstream side of the nip portion N. Further, the service life of a belt unit which drives the fixing roller 51 or the fixing belt 52 can be improved. Accordingly, the first pressure position and the second pressure position can be arranged in the area G, but it is more preferable that the first pressure position and the second pressure position be arranged outside the area G.

Figure 2:
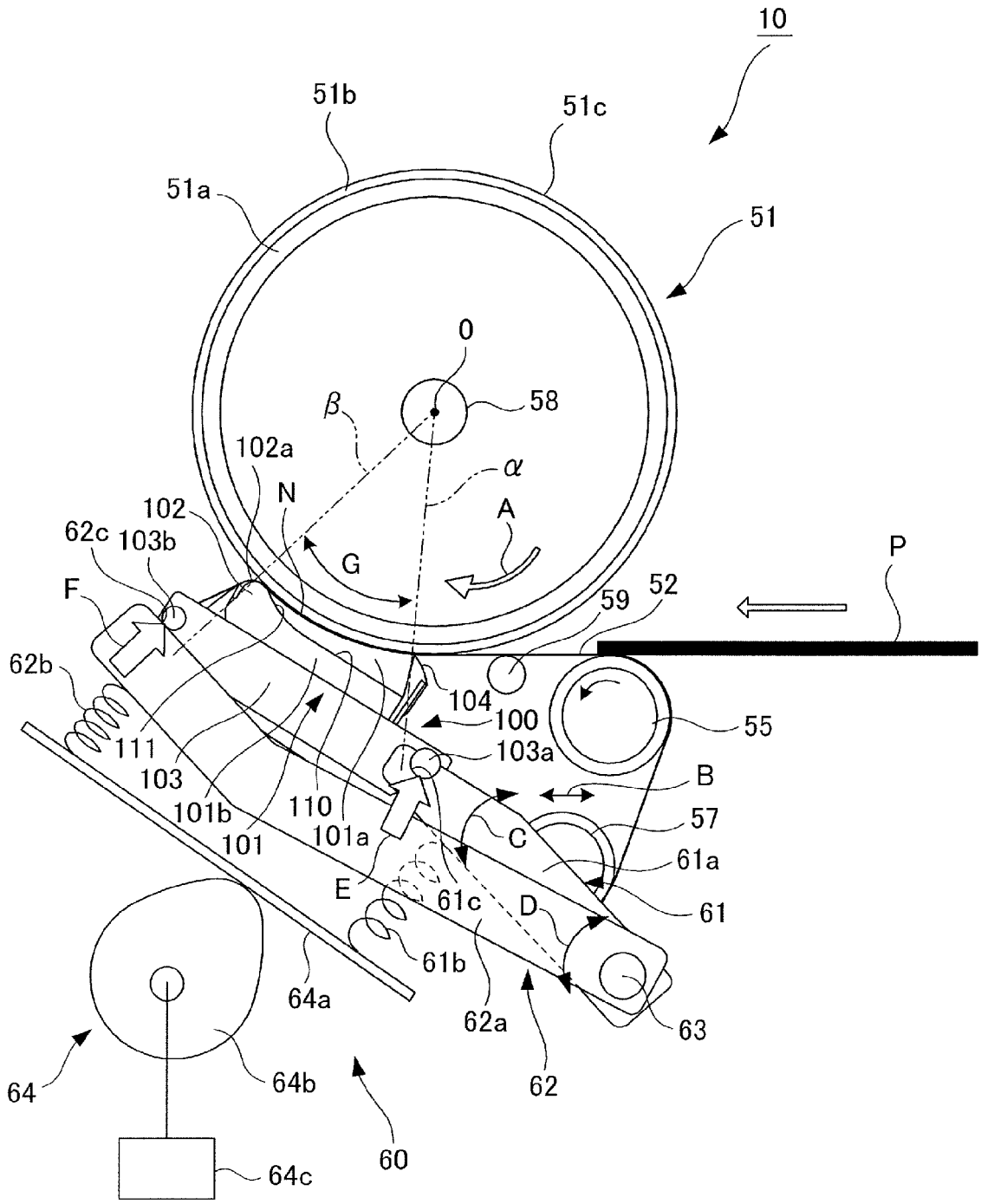
FIG. 2 is a cross-sectional view schematically illustrating the configuration of a fixing unit according to the first embodiment.
Figure 3:
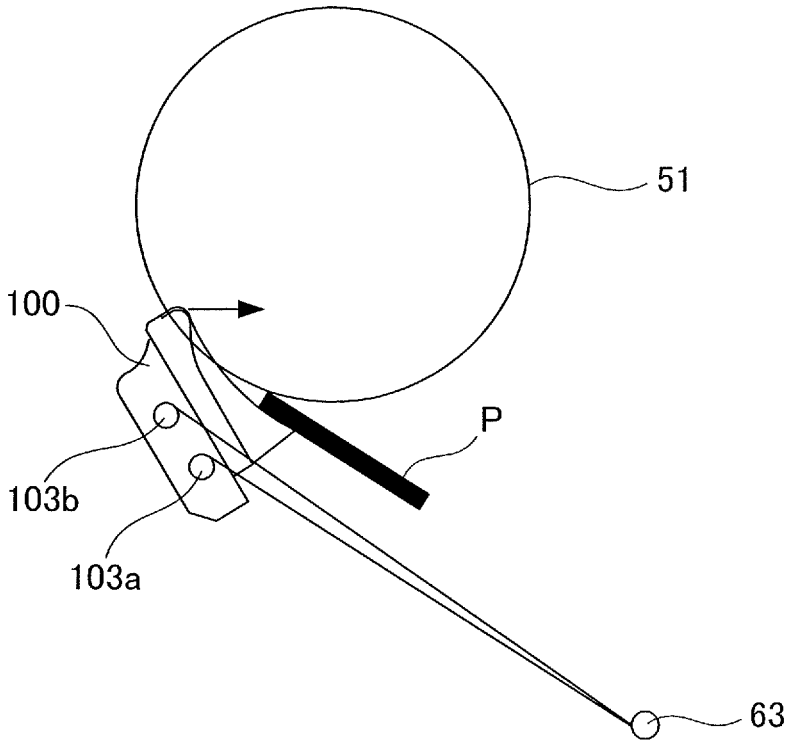
FIG. 3 is a view schematically illustrating a force acting when a front end of a recording medium is advanced to a nip portion in a case where a pressure position is shifted to the inside of the nip portion.

In addition, in the case of the present embodiment as described in FIG. 2, the fixing belt 52 is configured to be contactable with and separable from the fixing roller 51 by the cam mechanism 64. The cam mechanism 64 includes the moving member 64*a*, a cam 64*b*, and a motor 64*c*. Further, the fixing belt 52 is configured to be contactable with and separable from the fixing roller 51 by changing the phase of the cam 64*b* in contact with the moving member 64*a* by rotating and driving the cam 64*b* using the motor 64*c*. In a case where the toner image is fixed to the recording medium, the moving member 64*a* is moved by the cam 64*b*, the fixing belt 52 is brought into pressure contact with the fixing roller 51 through the pressure mechanism 60, and the nip portion N is formed. In contrast, in a case where an operation of fixing the toner image to the recording medium is not performed by the fixing unit 10, for example, in a standby state, the fixing belt 52 is separated from the fixing roller 51. Further, by changing the phase of the cam 64*b*, the biasing force of the first spring 61*b* and the second spring 62*b* are changed to change the pressing force of the integrated pad 100, so the width of the nip portion N in the conveyance direction of the recording medium may be changed.

In the case of the present embodiment, with the above-described configuration, the elastic layer of the integrated pad 100 and the fixing roller 51 is bent to form the nip portion N. Further, the pressure distribution of the nip portion N in the conveyance direction of the recording medium in a case where the recording medium is not present in the nip portion N has a shape of a solid line α in FIG. 6 described below. In contrast, cases where the front end of the recording medium is present in the nip portion N and the rear end of the recording medium is present in the nip portion N are described with reference to FIGS. 4 to 7.

Figure 4:
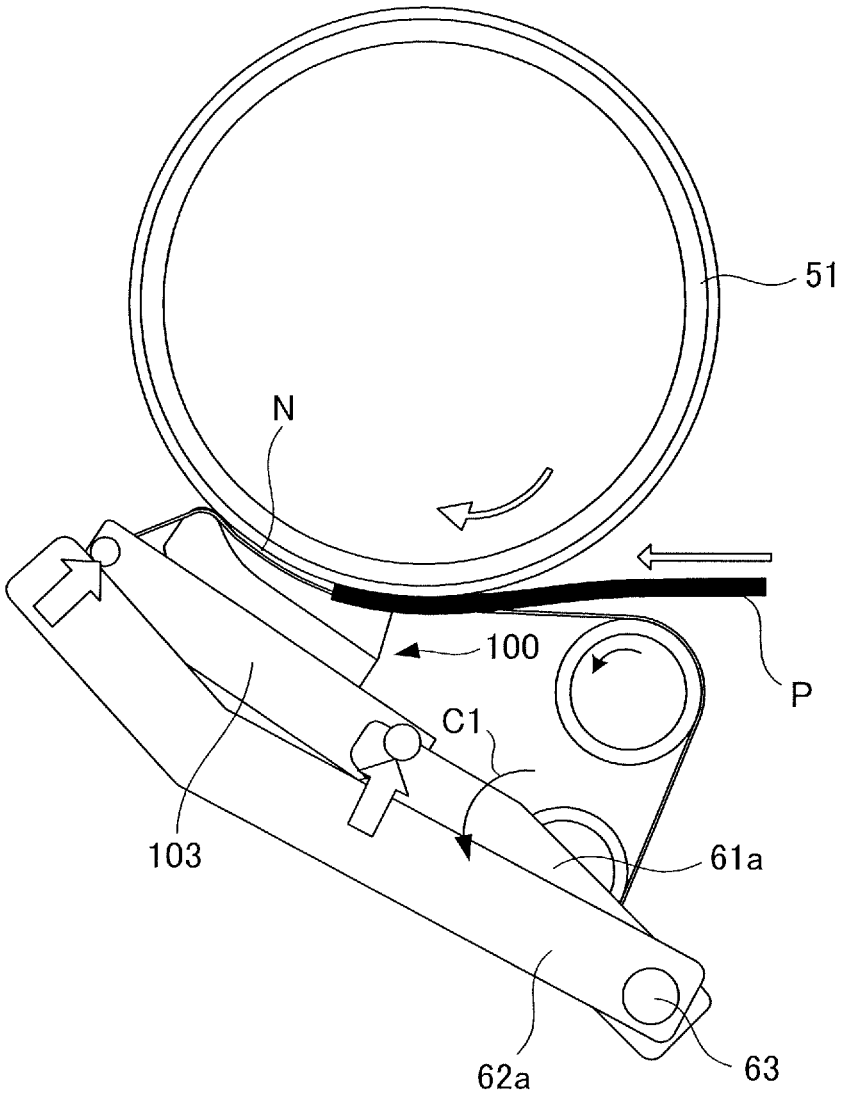
FIG. 4 is a cross-sectional view schematically illustrating the configuration of the fixing unit showing a state in which the front end of the recording medium is present in the nip portion in the first embodiment.

As shown in FIG. 4, since the front end of the cardboard P is nipped only by the upstream portion of the nip portion N in the conveyance direction in a state in which the front end of the cardboard P as the recording medium starts to enter the nip portion N, the first arm 61*a* is rotated about the swing shaft 63 in the arrow direction C1. In addition, the upstream side of the nip portion N of the integrated pad 100 is separated from the fixing roller 51 by the thickness of the cardboard P. Here, in the case of the present embodiment, the position of pressing the integrated pad 100 is divided into upstream and downstream positions. That is, the integrated pad 100 is pressed by dividing pressure points. Accordingly, even when the upstream side of the integrated pad 100 is separated from the fixing roller 51, the state of the downstream side holding pressure is maintained. The pressure distribution in the nip portion N in this state is as indicated by the dotted line b in FIG. 6.

Figure 6:
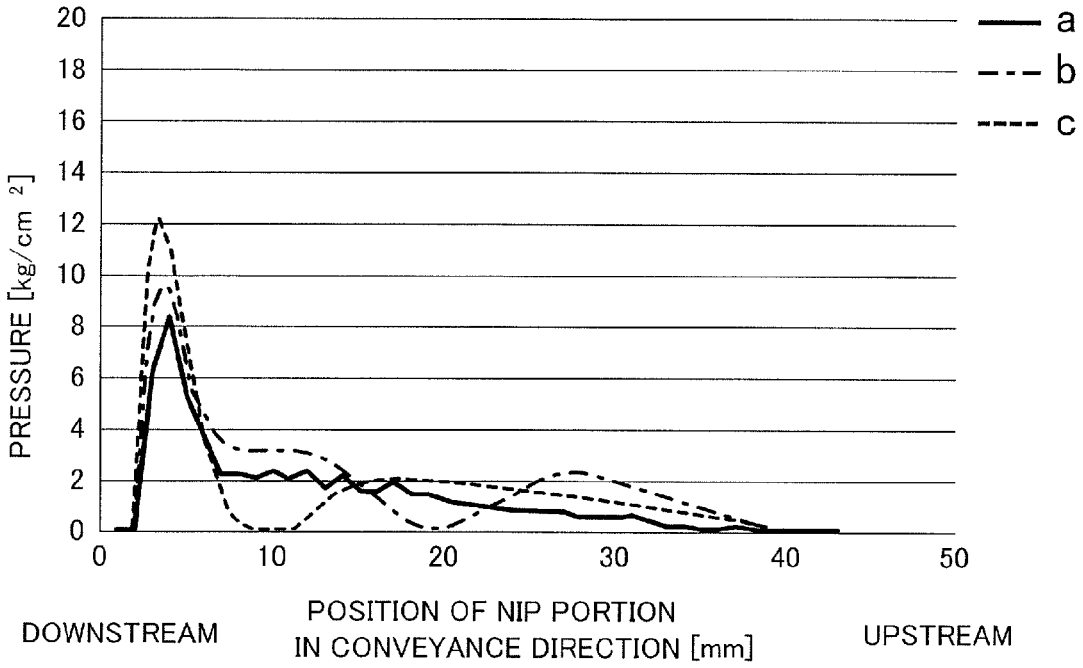
FIG. 6 is a view showing pressure distribution in the nip portion in cases where the recording medium is not present, the front end of the recording medium is present in the nip portion, and the rear end of the recording medium is present in the nip portion in the first embodiment.
Figure 7:
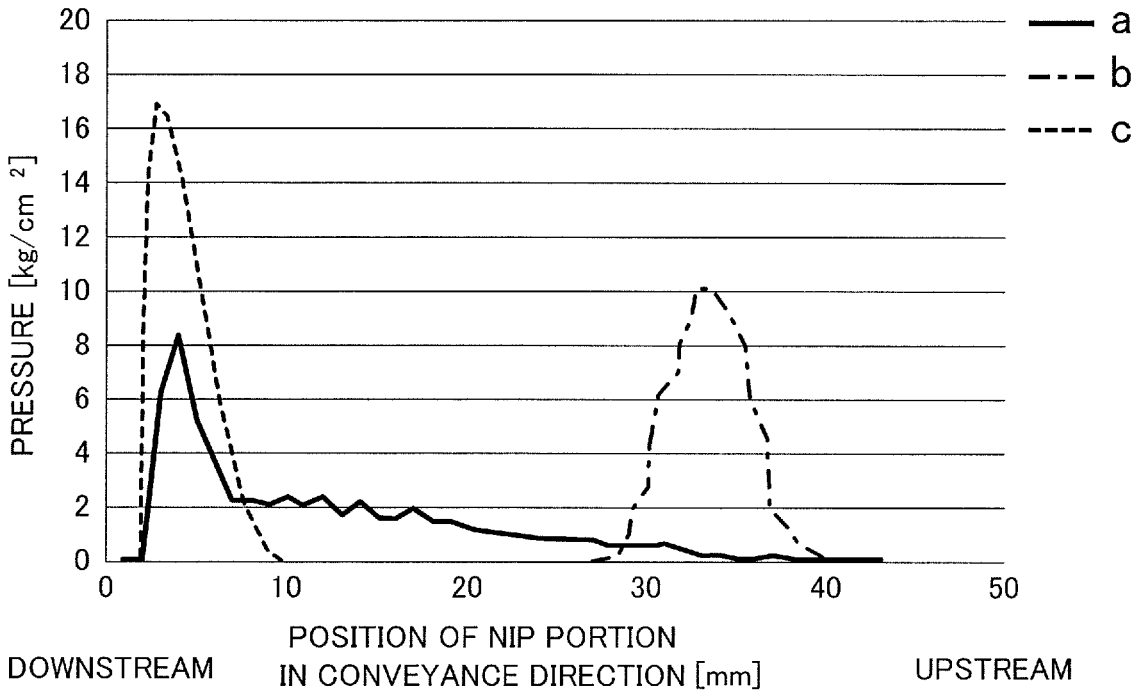
FIG. 7 is a view showing pressure distribution in the nip portion in cases where the recording medium is not present, the front end of the recording medium is present in the nip portion, and the rear end of the recording medium is present in the nip portion in a comparative example.
Figure 11:
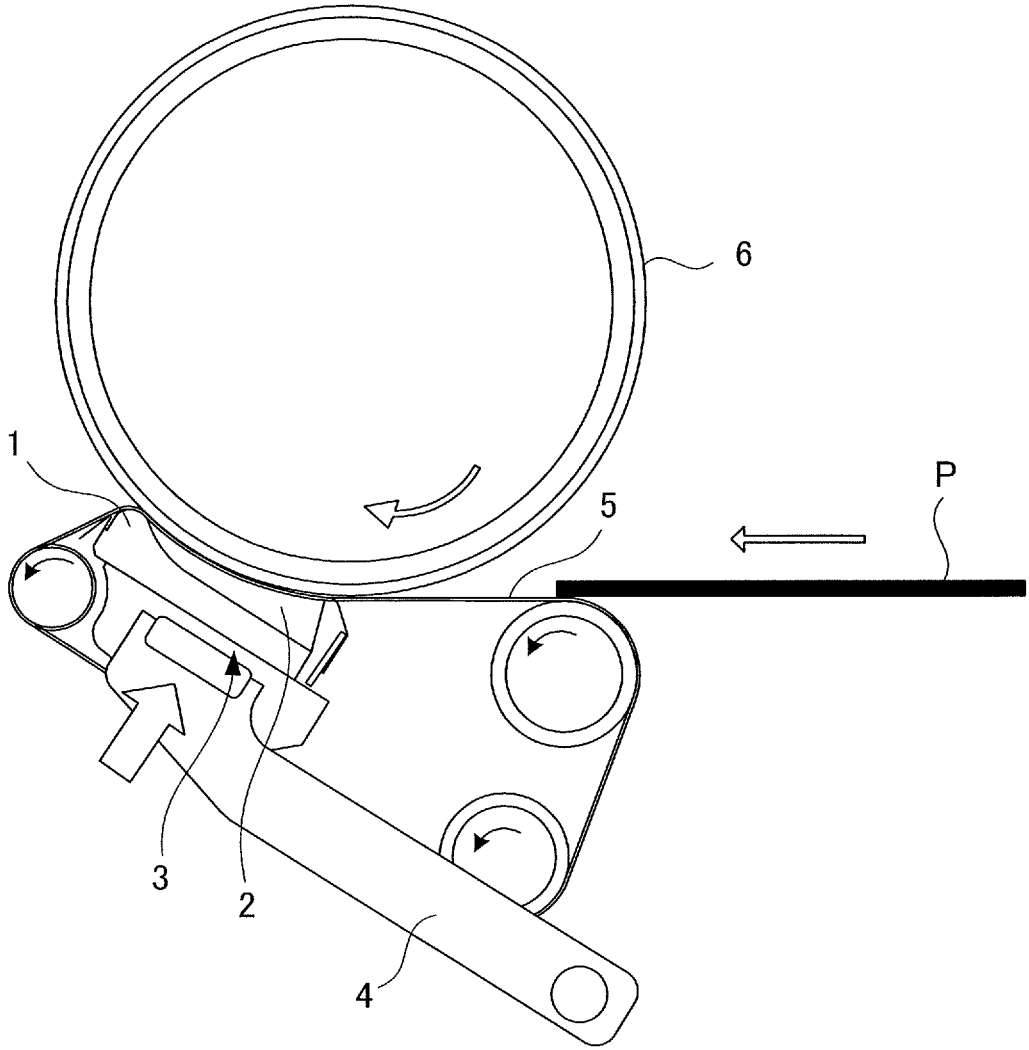
FIG. 11 is a cross-sectional view schematically illustrating the fixing unit according to the comparative example, in which a pressure pad and a separation portion are integrally formed.
Figure 12:
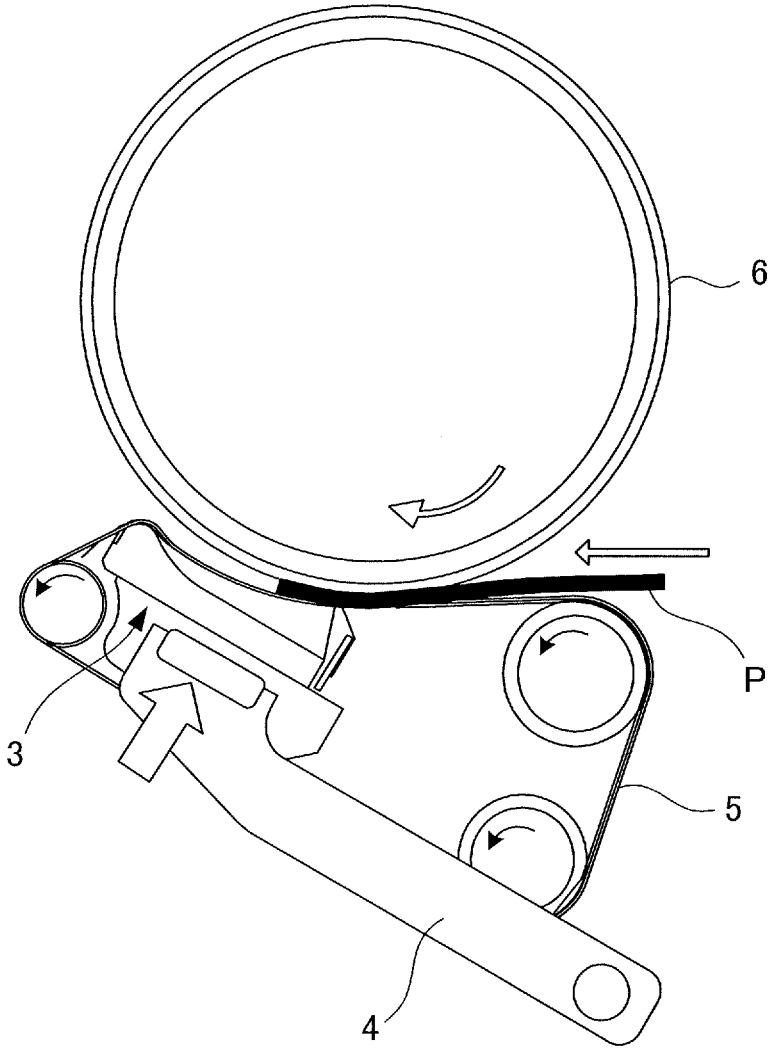
FIG. 12 is a cross-sectional view schematically illustrating the fixing unit in a state in which the front end of the recording medium is present in the nip portion in the comparative example.

On the other hand, as shown in FIG. 11, in the case of a configuration in which an integrated pad 3, configured by integrally forming the pressure pad 2 and the separation portion 1, is pressed at one location by the pressure mechanism 4 and a nip portion N is formed between the endless belt 5 and the fixing roller 6, that is, in the case of the configuration in which pressure points are not divided as a comparative example, the entire integrated pad 3 is separated from the fixing roller 6 when the front end of the cardboard P starts to be nipped as shown in FIG. 12. In addition, a gap is generated on the downstream side of the integrated pad 3, so the fixing belt 5 does not come into contact with the fixing roller 6. At this time, since the load applied to the integrated pad 3 is constant, the load is concentrated on front end of the cardboard P and the peak pressure is extremely increased when compared to a case in which a pressing force acting on the nip portion N by the cardboard P being nipped in the entire nip portion N is applied to the entire cardboard P when the width of the nip portion N in the conveyance direction is reduced. The pressure distribution in the nip portion N in a case where the front end of the cardboard P is present in the nip portion N in the comparative example is as indicated by the dotted line b in FIG. 7. In addition, the solid line a in FIG. 7 is the pressure distribution of the nip portion N in the conveyance direction of the recording medium in the case where the cardboard P is not present in the nip portion N in the comparative example. When the dotted line b in FIG. 6 is compared with the dotted line b in FIG. 7, it is understood that the pressure distribution of the nip portion N is stabilized compared to the comparative example in the case of the configuration of the present embodiment even when the front end of the cardboard P is present in the nip portion N.

Figure 5:
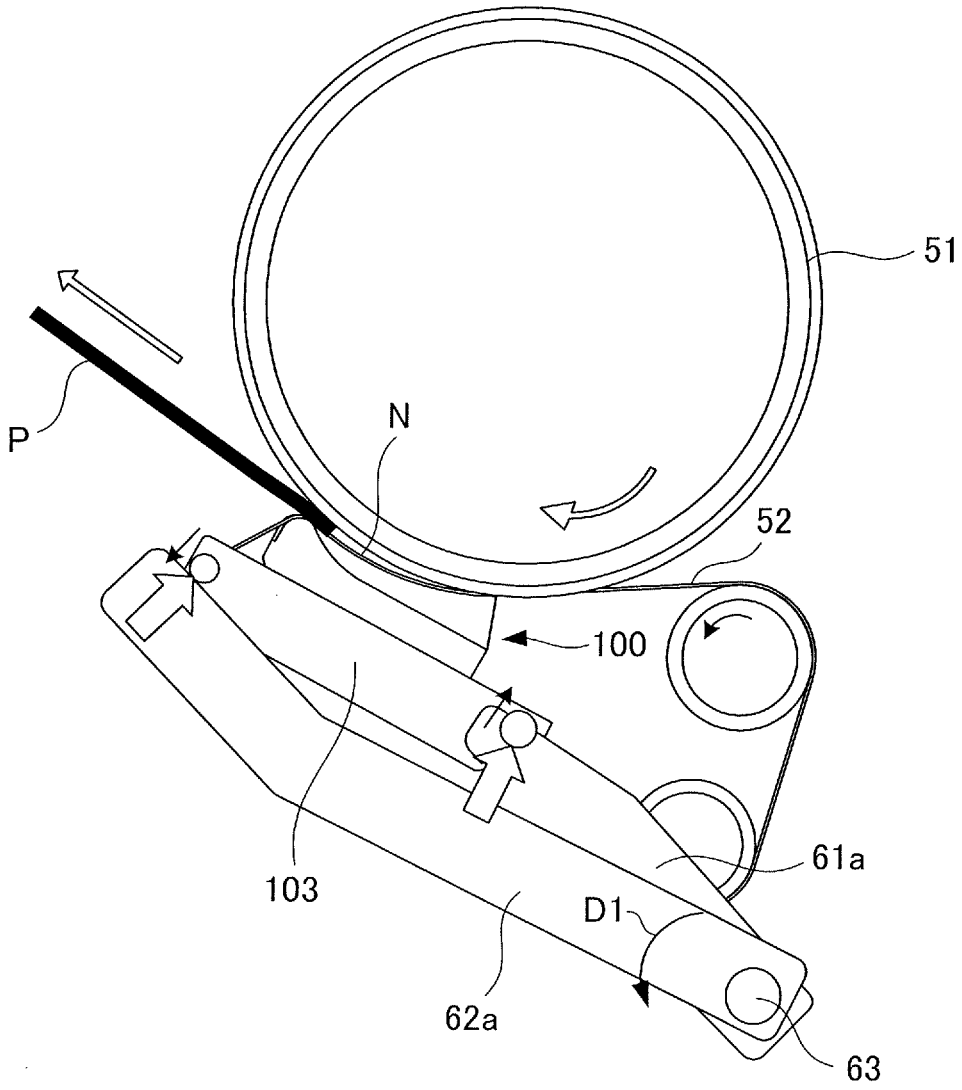
FIG. 5 is a cross-sectional view schematically illustrating the configuration of the fixing unit showing a state in which the rear end of the recording medium is present in the nip portion in the first embodiment.

Further, as shown in FIG. 5, in a state in which the rear end of the cardboard P is nipped in the nip portion N while the cardboard P is discharged from the nip portion N, the second arm 62*a* is rotated about the swing shaft 63 in the arrow Dl direction. In addition, the downstream side of the nip portion N of the integrated pad 100 is separated from the fixing roller 51 by the thickness of the cardboard P. In the case of the present embodiment, since the pressure points are divided into upstream and downstream points of the integrated pad 100 to be pressed, the state of the upstream side holding pressure is maintained even when the downstream side of the integrated pad 100 is separated from the fixing roller 51. The pressure distribution in the nip portion N in this state is as indicated by the broken line c in FIG. 6.

Figure 13:
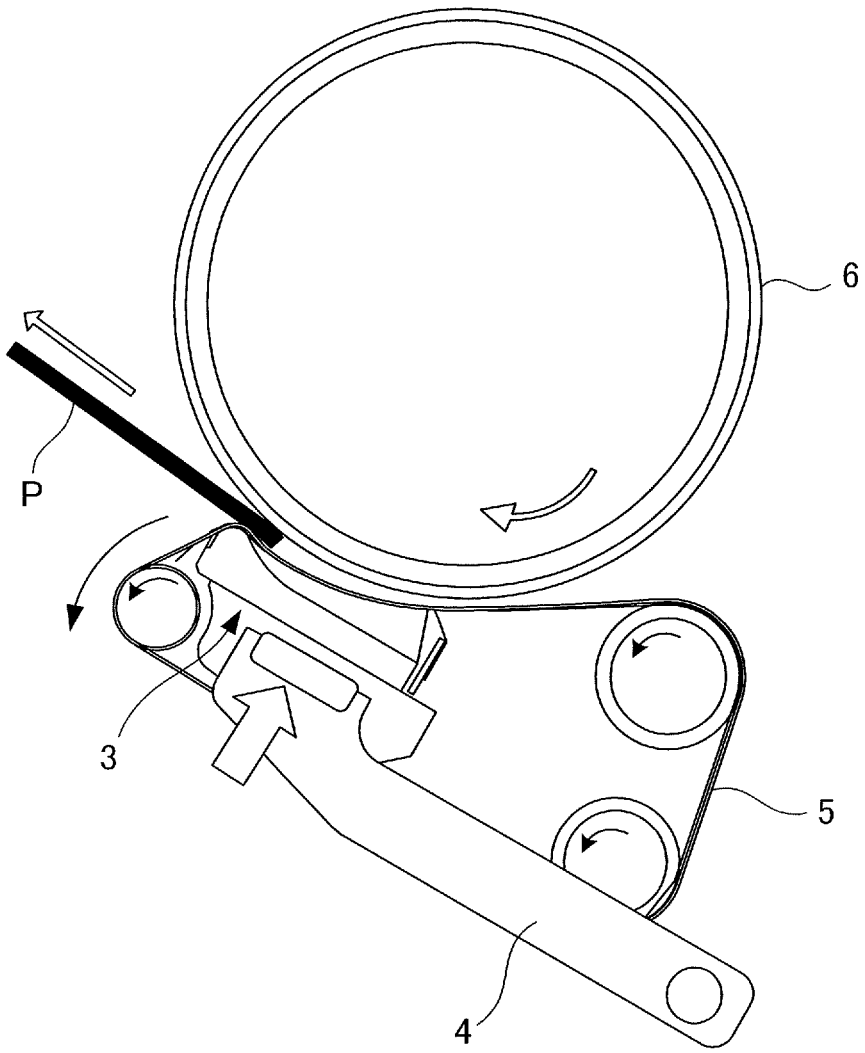
FIG. 13 is a cross-sectional view schematically illustrating the fixing unit in a state in which the rear end of the recording medium is present in the nip portion in the comparative example.

In contrast, in a case of the configuration in which the above-described pressure points are not divided, as described in FIG. 13, the entire integrated pad 3 is separated from the fixing roller 6 by nipping only the rear end of the cardboard P. Further, in the same manner as in FIG. 12, the width of the nip portion N in the conveyance direction is reduced, the load is concentrated on the rear end of the cardboard P, and the peak pressure is extremely increased. The pressure distribution in the nip portion N in the case where the rear end of the cardboard P is present in the nip portion N in the comparative example is as indicated by the broken line c in FIG. 7. When the broken line c in FIG. 6 is compared with the broken line c in FIG. 7, it is understood that the pressure distribution of the nip portion N is stabilized compared to the comparative example in the case of the configuration of the present embodiment even when the rear end of the cardboard P is present in the nip portion N.

In the case of the present embodiment, since the pad portion 101 and the separation portion 102 are integrally formed, a gap between the pad portion 101 and the separation portion 102 can be removed. As a result, the generation of the gloss unevenness generated when the air stays in a pressure decreasing portion of the nip portion N can be suppressed. Moreover, the upstream side and the downstream side of the integrated pad 100 in the rotation direction are independently pressed by the first pressing portion 61 and the second pressing portion 62 respectively. Therefore, as described above, even when the end portion (for example, the front end or the rear end of the cardboard P) of the recording medium is present in the nip portion N, the concentration of the pressure can be suppressed by nipping the end portion of the recording medium as shown in FIGS. 12 and 13 so that the pressing force acting on the end portion can be reduced. As a result, the strain applied to the fixing roller 6 by the front end or the rear end of the cardboard P can be suppressed and a mark of the end portion of the recording medium can be prevented from remaining in the fixing roller 51.

Here, in the configuration of the present embodiment and the comparative example, when a sheet of cardboard (basis weight: 350 g/m$^2$, size: A4) is allowed to be passed through the nip portion as the recording medium, the mark remaining on the surface of the fixing roller is measured. As a result, while the depth of the mark on the surface in the comparative example is 6 μm, the depth thereof in the configuration of the present embodiment is 2.5 μm, which is a reduction of more than or equal to half of the value in the comparative example. With this configuration, an image defect due to the mark on the fixing roller can be considerably improved and the damage on the fixing roller can be reduced, so the service life of the fixing roller can be improved.

Second Embodiment

Figure 8:
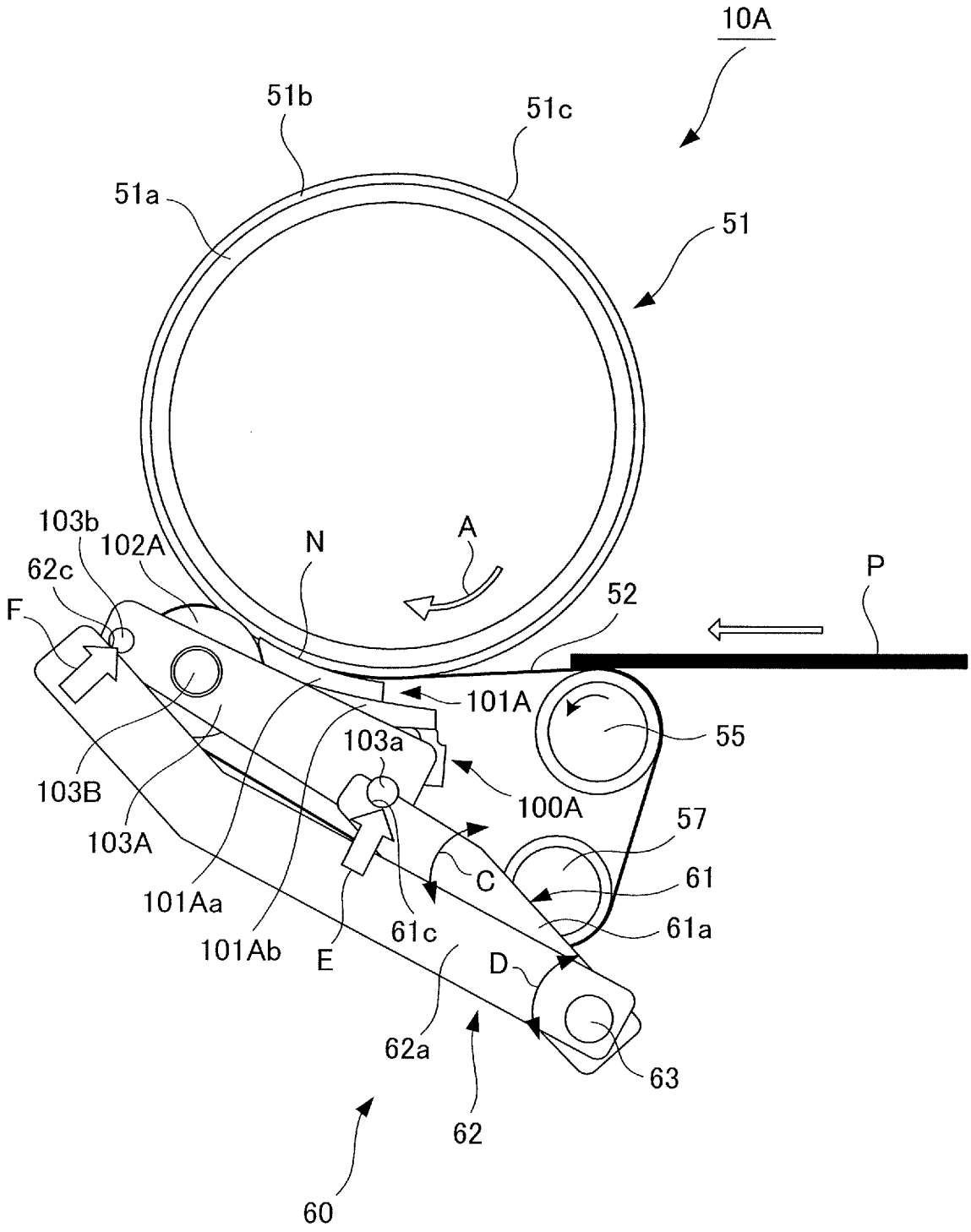
FIG. 8 is a cross-sectional view schematically illustrating the configuration of a fixing unit according to a second embodiment of the present invention.
Figure 9:
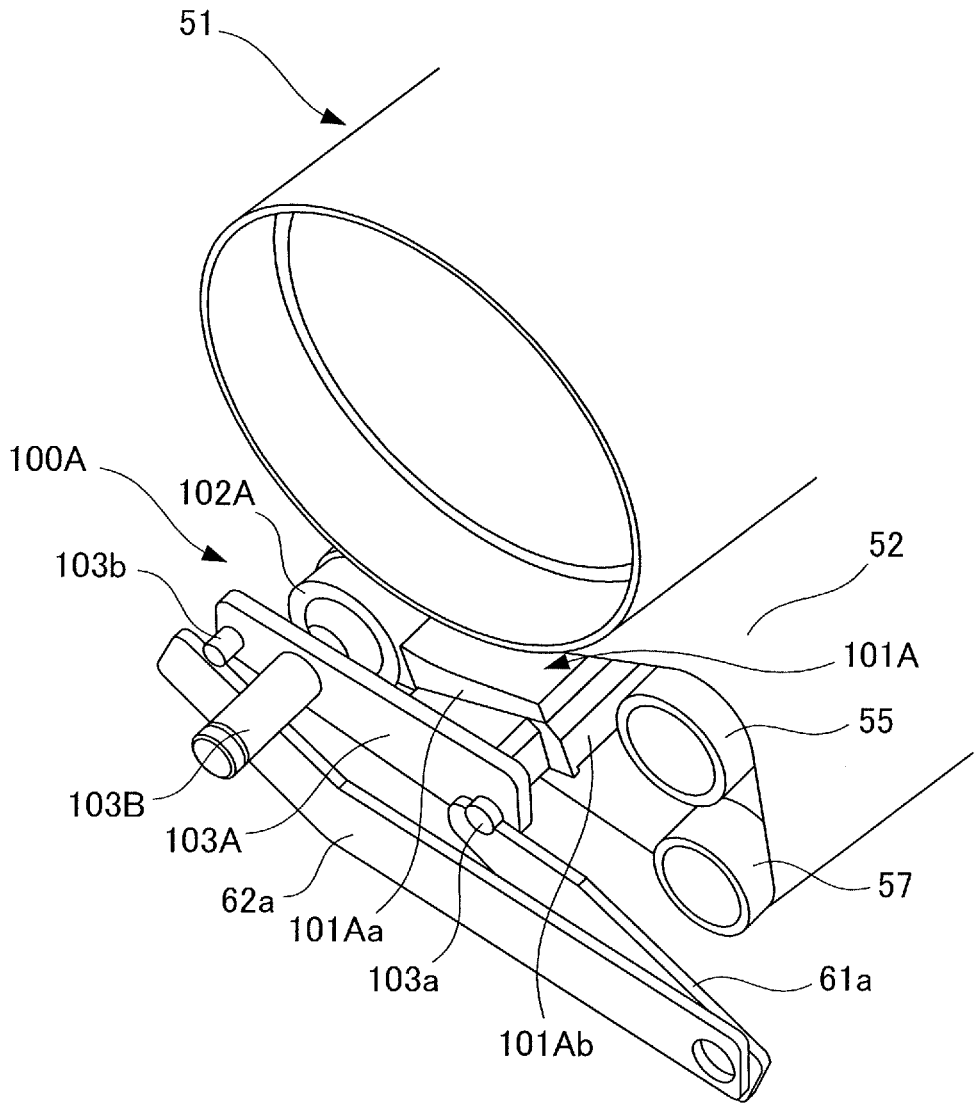
FIG. 9 is a perspective view schematically illustrating a part of the fixing unit according to the second embodiment.

A second embodiment of the present invention will be described with reference to FIGS. 8 and 9. A fixing unit 10A of the present embodiment is the same as that of the first embodiment described above except that an integrated pad 100A as an integrated member is formed of a pad portion 101A as a nip forming portion and a separation roller 102A as a separation portion. Therefore, a description of the configurations in common with the first embodiment will be omitted or simply done by denoting the same reference numerals and parts different from those of the first embodiment, which will be mainly described hereinafter.

In the case of the present embodiment, the pad portion 101A is a pad member which slides with respect to a fixing belt 52. In addition, the separation roller 102A is a separation rotary body which is positioned so as to only be rotatable with respect to the pad portion 101A on the downstream side of the pad portion 101A in the belt rotation direction (conveyance direction), comes into contact with the fixing belt 52, and is driven and rotated. Further, a nip portion N is formed by the pad portion 101A and the separation roller 102A.

In the case of the present embodiment, the separation roller 102A is rotatably supported by a pad holder 103A integrated with the pad portion 101A. That is, an elastic layer 101Aa and a pad base 101Ab constituting the pad portion 101A are supported by the upstream side or the intermediate portion of the pad holder 103A in the conveyance direction. Further, a rotating shaft 103B is fixed to the downstream side of the pad holder 103A in the conveyance direction and the separation roller 102A is rotatably supported by the rotating shaft 103B. In this manner, the pad portion 101A and the separation roller 102A can be integrally pressed toward a fixing roller 51.

The integrated pad 100A configured by integrally forming the pad portion 101A and the separation roller 102A is pressed by a first pressing portion 61 and a second pressing portion 62 independently from the upstream side and the downstream side of the integrated pad 100A, in the same manner as that of the above-described first embodiment. In addition, a heater 58 and a cam mechanism 64 are omitted in FIGS. 8 and 9, but the present embodiment also includes those in the same manner as that of the first embodiment.

Figure 10:
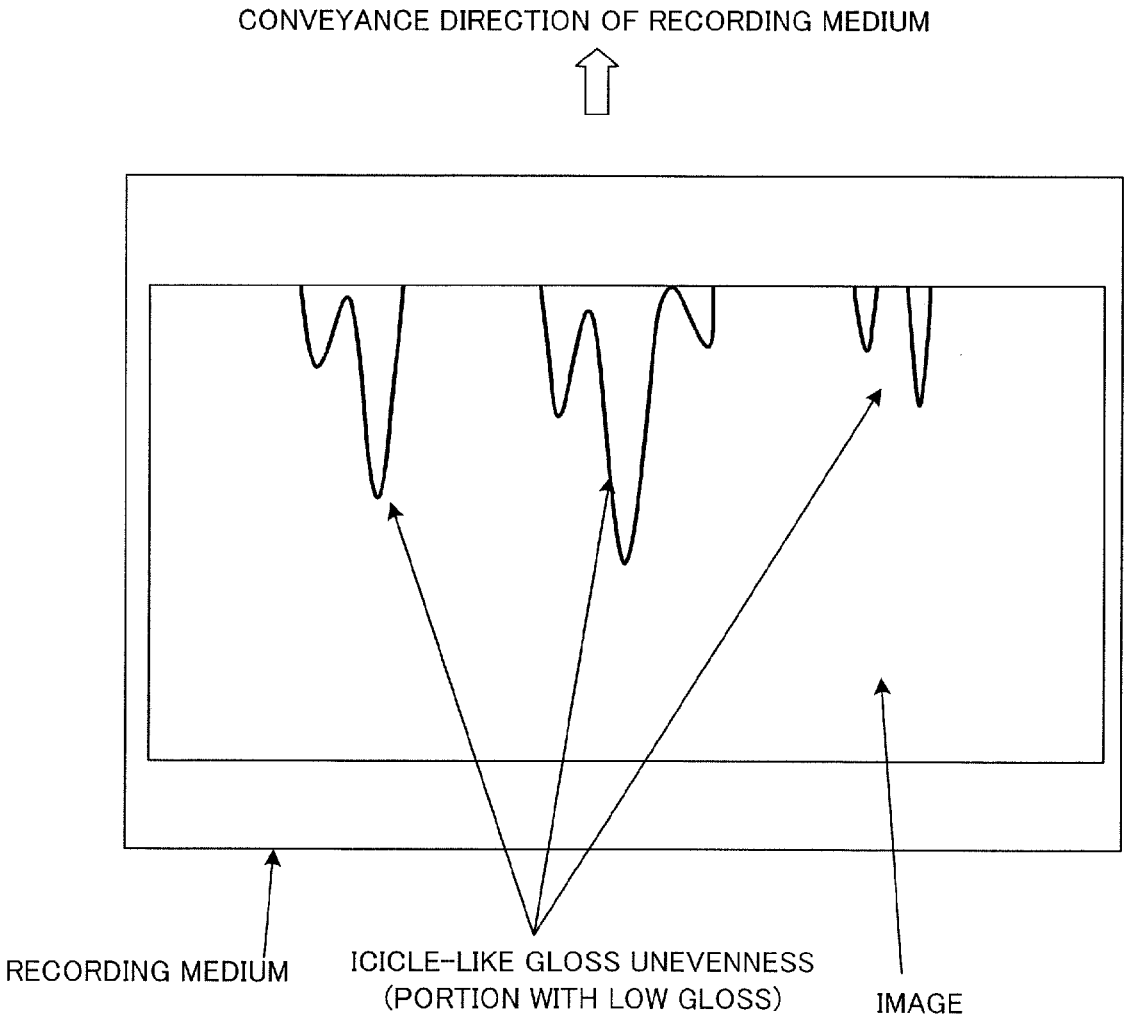
FIG. 10 is a view illustrating gloss unevenness generated in a recording medium.

Here, in the case of the configuration in the related art which is disclosed in JP-A-11-2979 described above, the pressure pad and the separation roller corresponding to the pad portion 101A of the present embodiment are independently pressed. However, since the separation roller and the pressure pad independently move when the two members are pressed independently in the above manner, a gap more than or equal to a certain distance becomes necessary between the two members. For example, the gap is approximately 2 mm. As a result, pressure release occurs in the nip portion due to the gap and the icicle-like gloss unevenness as shown in FIG. 10 described above is generated. Since the gloss unevenness has sensitivity in the width of the pressure release (that is, the size of the gap), the gloss unevenness as shown in FIG. 10 can be suppressed by reducing the size of the gap.

In the configuration of the present embodiment, since the separation roller 102A is fixed by the pad holder 103A such that the separation roller 102A is pressed integrally with the pad portion 101A, a positional relationship therebetween can be typically maintained to be constant. That is, the gap margin generated when two members independently move may not necessarily be provided, so the gap can be reduced. For example, the gap can be reduced to 0.8 mm. As a result, the width of the pressure release is reduced so that the icicle-like gloss unevenness as shown in FIG. 10 can be improved.

Further, in a case where the end portion of the recording medium is present in the nip portion, damage on the fixing roller due to the load concentration on the end portion of the recording medium may be generated by integrally forming the separation roller 102A and the pad portion 101A. However, in the present embodiment, since the pressure points of the integrated pad 100A are divided into pressure points on the upstream side and the downstream side in the same manner as that of the first embodiment, the concentrated load and the damage on the fixing roller can be reduced.

Further, in the case of the present embodiment, the separation portion for separating the recording medium from the fixing roller 51 is set as the separation roller 102A and the separation roller 102A is rotated by following the fixing belt 52. Therefore, the sliding resistance of the fixing belt 52 can be reduced when compared to the configuration in which the separation portion is allowed to slide with respect to the fixing belt 52 as in the first embodiment.

Another Embodiment

In the above-described description, the case in which the present invention is applied to an image forming apparatus having a full-color intermediate transfer system has been described. However, the present invention can be applied to a monochrome image forming apparatus having one image forming unit. In the case of the monochrome image forming apparatus, only an image carrier of black (K) is present, and a toner image formed on the image carrier is transferred to a recording medium by a transfer unit. Further, the present invention can be applied to a direct transfer system which directly transfers an image to a recording medium from a photoconductive drum in addition to the intermediate transfer system which includes an intermediate transfer member.

Furthermore, the fixing unit as the image heating apparatus of the present invention is not limited to the above-described configurations. For example, the fixing roller may be used as the endless belt. In addition, electromagnetic induction heating (IH), a ceramic heater, or the like can be used as heating portion in addition to the halogen heater.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-127137, filed Jun. 18, 2013, which is hereby incorporated by reference herein in its entirety.

What is claimed is:

1. An image heating apparatus comprising:

a rotatable member;

an endless belt configured to form a nip portion, in which a toner image on a sheet is heated, cooperatively with the rotatable member;

a pressing pad provided in an inside of the endless belt and configured to press the endless belt toward the rotatable member to form the nip portion, the pressing pad including:

a first portion extending from an entrance of the nip portion toward an exit of the nip portion in a sheet conveying direction; and a second portion disposed at a region in which the sheet is separated from the rotatable member, the pressure in the second portion being higher than that in the first portion; and a pressing mechanism configured to press the first portion and the second portion toward the rotatable member independently.

2. The image heating apparatus according to claim 1, wherein the pressing mechanism includes a first pressing portion pressing an upstream part in the sheet conveying direction of the pressing pad, and a second pressing portion pressing a downstream part in the sheet conveying direction of the pressing pad independently from the first pressing portion, wherein the first pressing portion presses the pressing pad at a first pressure position positioned upstream of a first virtual line which passes through a rotation center of the rotatable member and an upstream end of the nip portion in the sheet conveying direction, and wherein the second pressing portion presses the pressing pad at a second pressure position positioned upstream of a second virtual line which passes through the rotation center of the rotatable member and a downstream end of the nip portion in the sheet conveying direction.

3. The image heating apparatus according to claim 2, wherein the first pressing portion includes a first swing member swingably supported by a swing shaft and a first biasing member biasing the first swing member toward the pressing pad, and wherein the second pressing portion includes a second swing member swingably supported by the swing shaft independently from the first swing member and a second biasing member biasing the second swing member toward the pressing pad.

4. The image heating apparatus according to claim 3, wherein one of the first swing member and the second swing member rotatably supports only the pressing pad, and the other one of the first swing member and the second swing member supports the pressing pad such that the pressing pad is rotatable and movable along the other member.

5. The image heating apparatus according to claim 1, wherein the second portion is formed as a member which is integrally continuous with the first portion on the downstream end of the first portion in the sheet conveying direction and includes an outer peripheral surface having a predetermined curvature and sliding with respect to the endless belt.

6. The image heating apparatus comprising:

a rotatable member;

an endless belt configured to form a nip portion, in which a toner image on a sheet is heated, cooperatively with the rotatable member;

an integrated member provided in an inside of the endless belt and configured to press the endless belt toward the rotatable member to form the nip portion, the integrated member including:

a pad member extending from an entrance of the nip portion toward an exit of the nip portion in a sheet conveying direction; and a separation rotary body positioned downstream of the pad member in the sheet conveying direction, configured to be movable with respect to the pad member only in a rotation direction of the separation rotary body, and rotating by contacting the endless belt;

a pressing mechanism configured to press the pad member and the separation rotary body toward the rotatable member independently.

* * * * *